US006662536B2

(12) United States Patent
Belton et al.

(10) Patent No.: US 6,662,536 B2
(45) Date of Patent: Dec. 16, 2003

(54) PRESSURE RELIEVING BRIDLE

(75) Inventors: Geoffrey Paul Belton, Heath Hill (GB); Klaus Balkenhol, Rosendahl/Osterwiek (DE)

(73) Assignee: Albion Saddlemakers Co Ltd., Walsall (GB)

( * ) Notice: Subject to any disclaimer, the term of this patent is extended or adjusted under 35 U.S.C. 154(b) by 0 days.

(21) Appl. No.: 10/077,177

(22) Filed: Feb. 15, 2002

(65) Prior Publication Data

US 2003/0066272 A1 Apr. 10, 2003

(30) Foreign Application Priority Data

Oct. 10, 2001 (GB) ..... 0124290

(51) Int. Cl.[7] ..... B68B 1/06
(52) U.S. Cl. ..... 54/7; 54/9; 54/12; 54/6.1
(58) Field of Search ..... 119/709–712, 833; 54/6.1, 6.2, 7–9, 12

(56) References Cited

U.S. PATENT DOCUMENTS

| | | | | | |
|---|---|---|---|---|---|
| 505,658 | A | * | 9/1893 | Hill | 54/6.1 |
| 734,004 | A | * | 7/1903 | Stiegler | 54/6.2 |
| 2,804,741 | A | * | 9/1957 | Cheesebro | 54/16 |
| 3,981,124 | A | * | 9/1976 | Kibler | 24/164 |
| 4,535,724 | A | * | 8/1985 | David | 119/712 |
| 4,722,171 | A | * | 2/1988 | Meroth | 54/6.1 |
| 4,953,345 | A | * | 9/1990 | Boone | 54/13 |
| 5,503,894 | A | * | 4/1996 | Brown | 119/792 |
| 6,408,603 | B1 | * | 6/2002 | Babuik | 54/22 |

FOREIGN PATENT DOCUMENTS

| | | | | |
|---|---|---|---|---|
| DE | 743068 | | 12/1943 | |
| DE | 743068 | A * | 12/1943 | 54/6.1 |
| DE | 19744182 | A1 | 4/1999 | |
| DE | 20101367 | | 5/2001 | |
| FR | 434 152 | A1 | 6/1991 | |
| GB | 171487 | * | 8/1920 | 54/6.1 |
| GB | 259547 | | 8/1927 | |
| GB | 371180 | | 4/1932 | |

OTHER PUBLICATIONS

Advanced Equine Products: Riding Bridles from Zilco: The MS Bridle [online], [retrieved on Jan. 27, 2003]. Retrieved from the Internet: <URL: http://www.advancedequine.com/endurance/bridles.html>.*

* cited by examiner

*Primary Examiner*—Charles T. Jordan
*Assistant Examiner*—Elizabeth Shaw
(74) *Attorney, Agent, or Firm*—Greenlee, Winner and Sullivan, P.C.

(57) ABSTRACT

A snaffle bridle in accordance with this invention comprises a broad nose band strap (24), to which the nose band (26) and the throat lash (28) are connected, and a second, similarly broad head strap (30) which carries the bit (14) by way of the cheek straps **(32*a*, 32*b*). A cushioning pad is utilised, which is laid over the horse's head prior to mounting the nose band strap (24), spreading the load which is applied to the head during the use of the bit. Similarly, a weymouth bridle comprises a nose band strap (70), carrying the nose band (74) and throat lash (78), whilst a second head strap (80) carries the weymouth bit straps (84*a* and 84*b*) and snaffle bit straps (88*a* and 88*b*)**.

8 Claims, 4 Drawing Sheets

PRESSURE RELIEVING BRIDLE

CROSS REFERENCE TO RELATED APPLICATIONS

This application claims priority from UK Application Ser. No. 0124290 filed Oct. 10, 2001.

BACKGROUND OF THE INVENTION

A conventional snaffle bridle comprises a nose band strap, adapted to be laid over the horse's head immediately behind the horse's ears, and a snaffle head, which lies on top of the nose band strap, the snaffle head carrying the throat lash, and also cheek straps to which the snaffle bit is attached.

Similarly, a conventional weymouth bridle comprises a weymouth strap which carries the cheek straps to which the weymouth bit is attached, and from which the throat lash extends, the weymouth strap similarly being located over the horse's head immediately behind the ears. Mounted immediately underneath the weymouth strap is the snaffle (bradoon) strap, which carries the snaffle bit, and, under the snaffle strap, a nose band strap carrying the nose band.

A problem which is encountered in the use of conventional bridles, particularly in competitive environments, is what is referred to as "head shaking": when exercising control over the horse it commences to shake its head violently, which disrupts its performance.

A number of causes of this phenomenon have been postulated, including that of unruly behaviour, and attempts to control the horse have exacerbated the problem.

Without intending to be bound by a theory of operation, we believe that head shaking is caused by downward pressure on a nerve area of the horse's head, and we have found that, by the re-design of the bridle with a particular view to increasing the area of the head to which the pressure is applied, the high levels of control needed in competition environments can be exercised without producing head shaking.

SUMMARY OF THE INVENTION

It is one of the objects of this invention to provide a bridle which will reduce pressure on a horse's head, and permit action of bit-carrying parts of a bridle independent of non-moving parts of the bridle, to alleviate head shake.

According to this invention there is provided a bridle in which the throat lash is carried on a strap other than the strap which carries a bit. The bridle comprises a first head strap on which a throat lash is attached, and a separate, second head strap which carries a bit.

Separating the throat lash strap from the head strap which carries the bit permits the bridle to be designed in such a way as to reduce downward pressure on the horse's head. Specifically, this fundamental change permits a number of radical design features to be employed. For example, it permits the use of a head strap which carries stable, non-moving components such as the nose band and the throat lash, and thus enables the use of a broader band strap over which the head strap which carries the bridle can be placed. In this way tendency for high pressure contact to occur can be reduced.

Additionally, the invention permits the use of a cushioning strap which may be located beneath the first head strap which carries the throat lash and the nose band, whereby two broad layers are located between the horse's head and the second, bit-carrying head strap.

Conveniently the throat lash and the nose band are carried by an integral head strap.

Where the bridle is a weymouth bridle, conveniently the weymouth bit and the snaffle bit are carried by an integral head strap.

Preferably the integral head strap is padded, and preferably the bridle comprises a first head strap which carries the throat lash.

Preferably the first head strap is padded, and preferably the bridle comprises a padded member adapted to be laid over the horse's head, and onto which the first head strap may be placed.

Preferably the padded member provides an upwardly convex surface, to retain the head strap in position.

According to this invention there is also provided a weymouth bridle in which the bits, throat lash and nose band are carried by two broad head straps, which are mounted one on top of the other.

Preferably one of the head straps carries both the bits, the other carrying the throat lash and the nose band, and preferably the strap which carries the bits is mounted above (ie. on top of) the other strap.

According to this invention there is also provided a snaffle bridle comprising a broad nose band strap, located beneath the snaffle strap.

Preferably the nose strap also carries the throat lash.

There will now be given detailed descriptions, to be read with reference to the accompanying drawings, of two conventional bridles, and two bridles in accordance with this invention, which have been selected for the purposes of illustrating the invention by way of example.

DETAILED DESCRIPTION OF THE INVENTION

Figure 1:
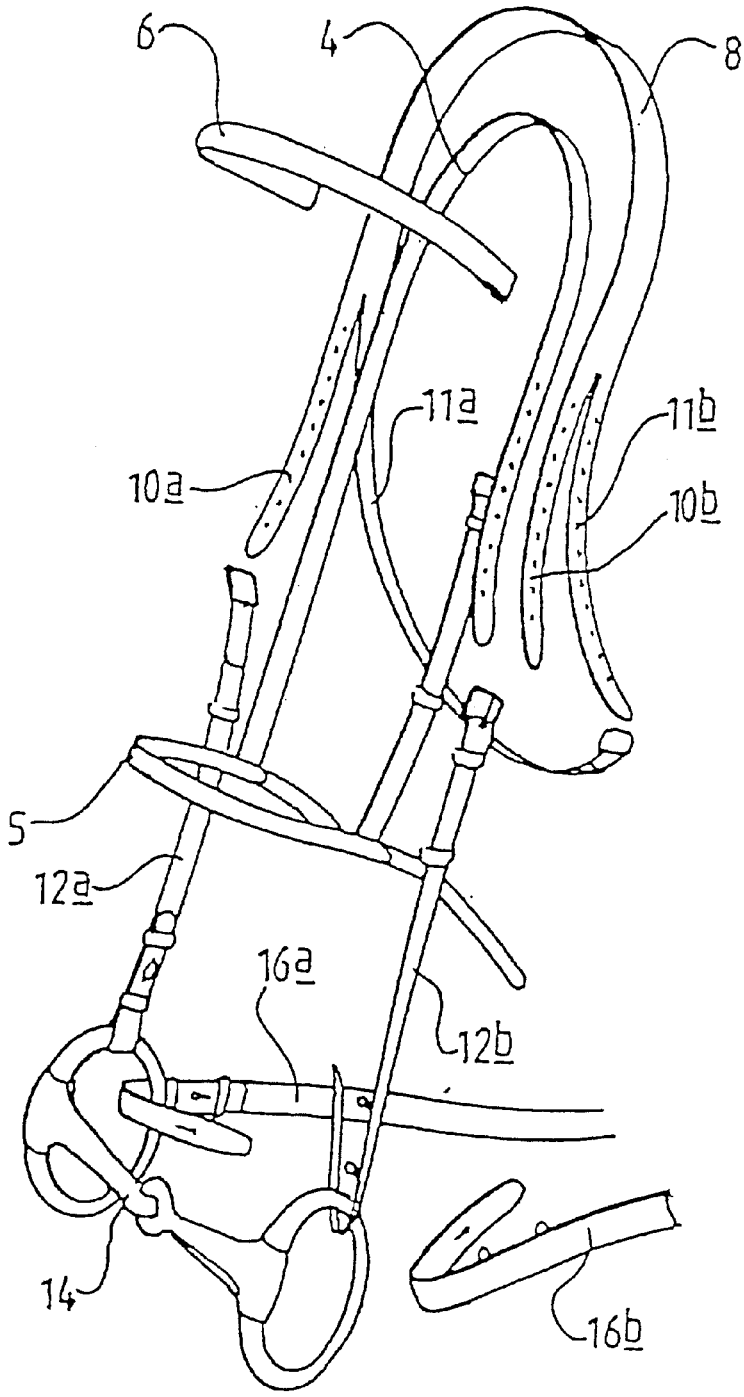
FIG. 1 (Prior Art)
FIG. 1 is a schematic perspective view of a conventional snaffle bridle.

The conventional snaffle bridle shown in FIG. 1 comprises a nose band strap 4, carrying a nose band 5, and which is mounted over the horse's head immediately behind the ears and tightened with a conventional buckle. Placed on top of the nose band strap is a snaffle head strap 8, which comprises two forward straps 10*a* and 10*b*, to which cheek straps 12*a*, 12*b* are attached, which carry the snaffle bit 14.

The head strap 8 also comprises two rear portions, 11*a*, 11*b*, which afford the throat lash of the bridle. In use, the straps 4 and 8 are held together by a brow band 6 which passes in front of the horse's ears.

The bit 14 is connected to the reins 16*a*, 16*b* in conventional manner, and on pulling back of the reins, downward pressure is exerted on the horse's head by the snaffle strap 8 through the relatively narrow nose band strap 4, causing a high force per unit area to be applied to the horses' head.

Figure 2:
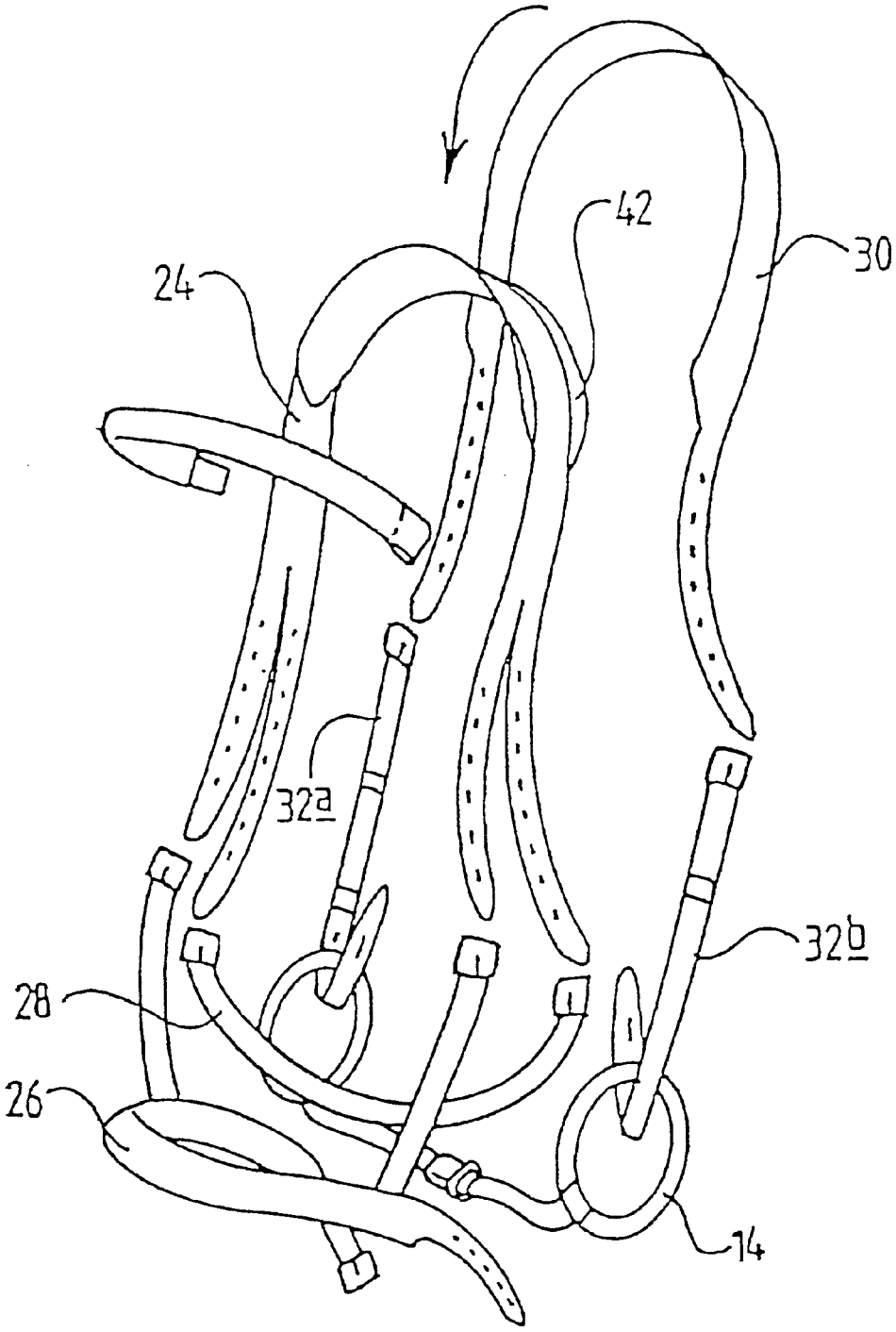
FIG. 2 is a schematic perspective view of a snaffle bridle in accordance with this invention.

The snaffle bridle in accordance with this invention, shown in FIG. 2, comprises a broad nose band strap 24, to which both the nose band 26 and the throat lash 28 are connected, and a second, similarly broad head strap 30 which carries the bit 14 by way of the cheek straps 32*a*, 32*b*.

The snaffle bridle in accordance with this invention also comprises a cushioning pad 42, which is laid over the horse's head prior to mounting the first head band strap 24, spreading the load which is applied to the head during the use of the bit. The cushion 42 conveniently presents a slight upward concavity, assisting a retention of the cushion 42 in a desired location, and permitting second head strap 30 to be located in position on top of the strap 24.

When during use of the bridle shown in FIG. 2 rearward force is applied to the bit 14 by the reins in conventional manner, downward pressure applied by the bit is taken up by a strap which carries the bit only, and not by a strap which also carries non-moving parts of the bridle such as the throat lash or nose band. The downward pressure applied by the strap 30 will be spread over a broad area by the pad 42, which we have found significantly reduces tendency for head shake to occur.

Figure 3:
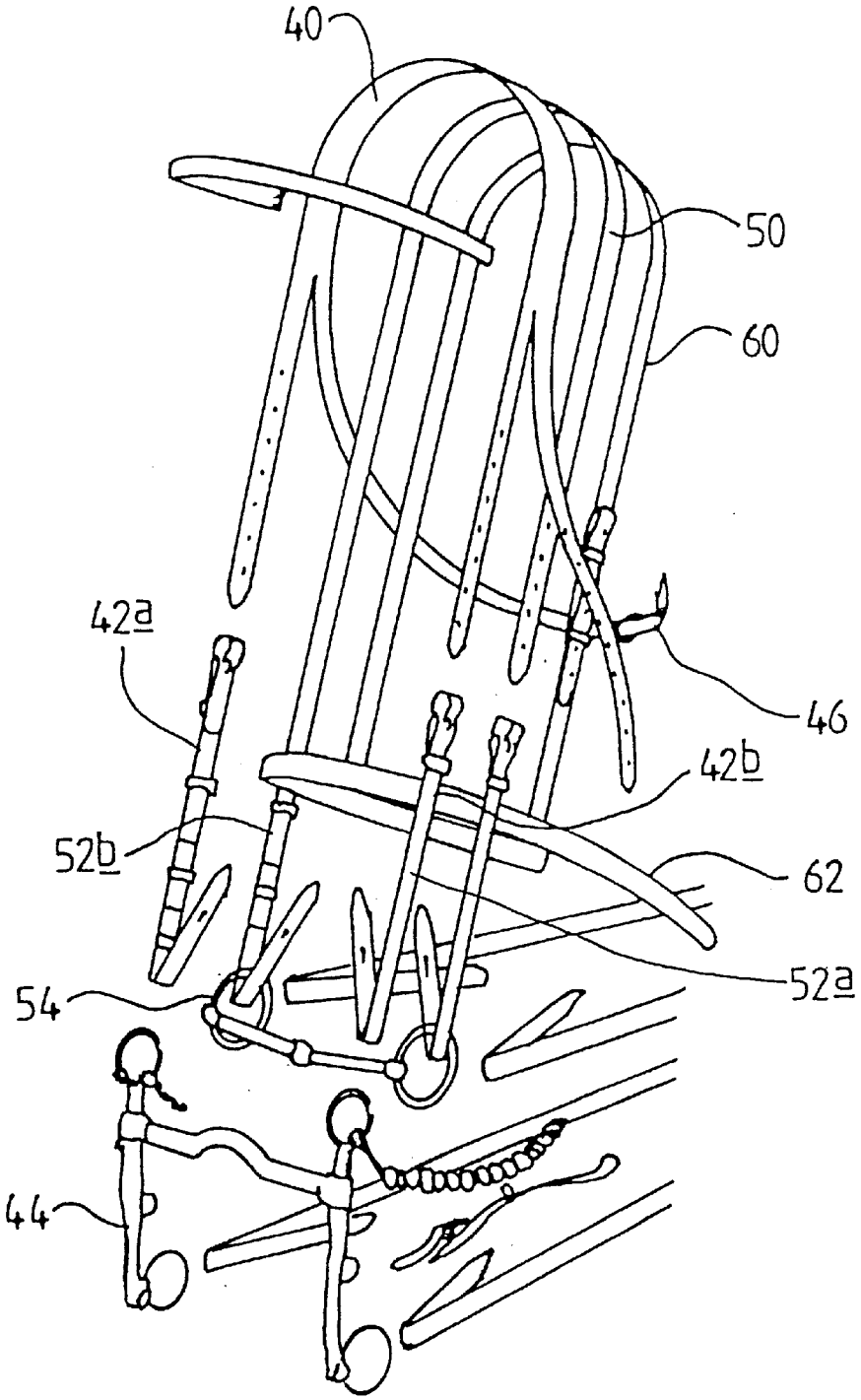
FIG. 3 (Prior Art)
FIG. 3 is a schematic perspective view of a conventional weymouth bridle.

The bridle shown in FIG. 3 is a conventional weymouth bridle, comprising a weymouth strap 40 which is connected by way of cheek straps 42*a*, 42*b* to a weymouth bit 44, the weymouth strap also carrying the throat lash 46. In use the weymouth strap is located on the horse's head immediately behind the ears.

Mounted beneath the strap 40 is a bradoon or snaffle strap 50, which carries by way of cheek straps 52*a*, 52*b* a snaffle bit 54. Also positioned between the weymouth strap 40 is a nose band strap 60, which carries the nose band 62.

In the use of the standard weymouth bridle, downward pressure on the horse's head is primarily produced by the weymouth bit 44, and transmitted to the horse's head by the relatively narrow weymouth strap 40. Downward pressure is also produced by the snaffle bit 54 through the snaffle strap 50, which is similarly relatively narrow, producing high forces per unit area.

Figure 4:
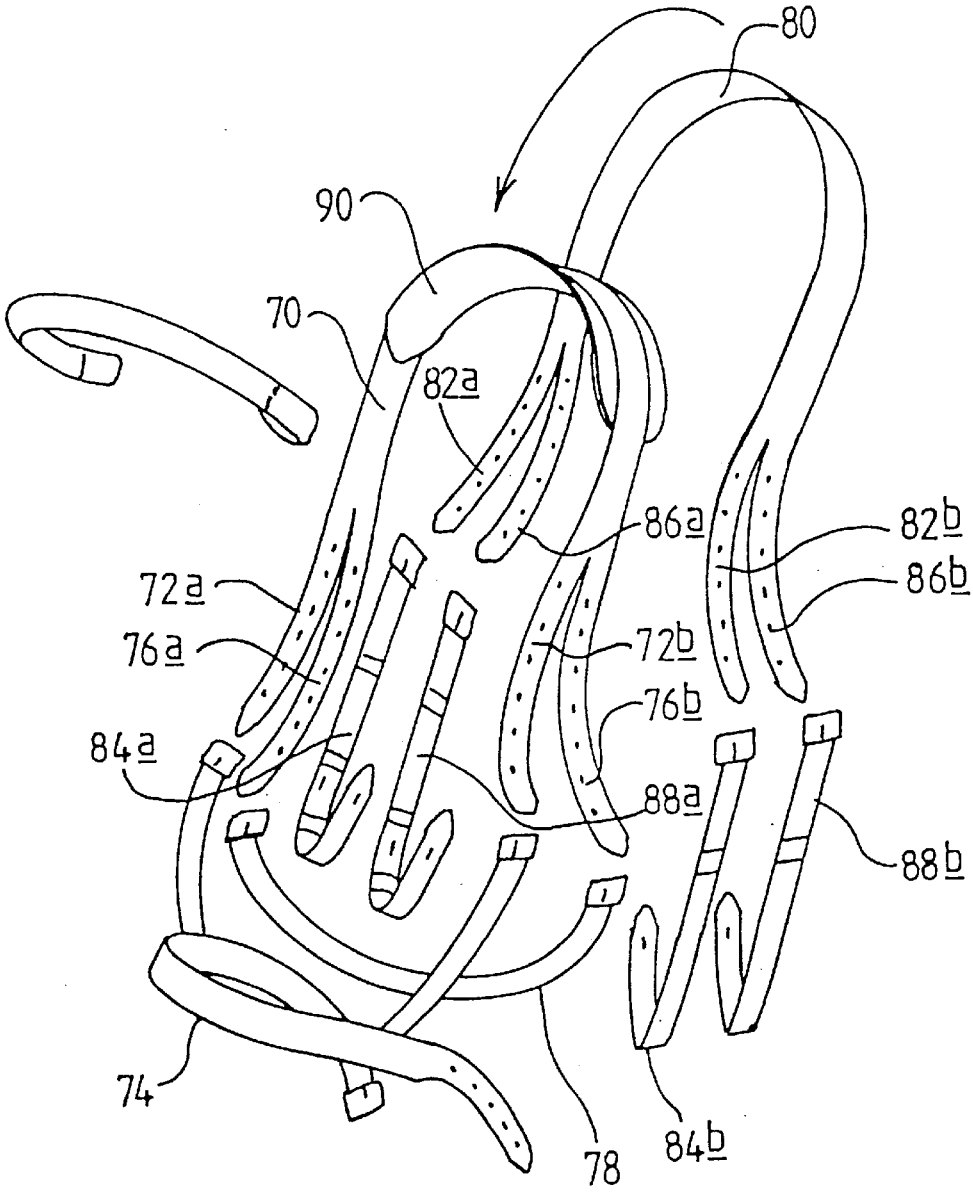
FIG. 4 is a schematic perspective view of a weymouth bridle in accordance with this invention.

The weymouth bridle in accordance with this invention is shown in FIG. 4, comprising a first, head strap 70, comprising strap portions 72*a*, 72*b* which carry the nose band 74, and strap portions 76*a*, 76*b*, which carry the throat lash 78.

Mounted above the first head strap 70 is a second, head strap 80, comprising strap portions 82*a*, 82*b*, which carry weymouth bit straps 84*a* and 84*b*, to which a weymouth bit (not shown) is attached, and strap portions 86*a*, 86*b* which carry snaffle bit straps 88*a*, 88*b*, to which a snaffle bit (not shown) is secured.

The weymouth bridle in accordance with this invention also comprises a cushioning pad 90, which may similarly be convex in cross-section, onto which the first strap 70 is mounted, with the second strap 80 mounted over the first strap 70. Both straps 70 and 80 may be significantly broader than is conventional, which in addition to the pad 90 spread the load applied to the horse's head over a large area.

In FIG. 4 the strap 80 carries both the weymouth and snaffle bits. Alternatively, the strap 80 may be divided, comprising separate straps for the weymouth and the snaffle bits, providing for easier adjustment of the bridle, without any detrimental effect to the pressure on the horse's head.

The browband 6 is attached in conventional manner, with a loop on each end through which both the bit head strap 80 and the throat latch/nose band head strap 70 are passed.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A weymouth bridle comprising two bits, a throat lash and a nose band in which the throat lash and nose band are carried by a first head strap and the bits are carried by a second head strap and the second broad head strap is mounted on top of the first broad head strap.

2. A bridle according to claim 1 comprising a padded member laid over the head of the horse wherein the first head strap is located on the padded member.

3. A bridle comprising a first head strap carrying a throat lash and nose band, and a second head strap which carries at least one bit, the bridle further comprising a padded member, wherein the padded member is laid over the head of the horse, the first head strap is located on top of the padded member and the second head strap is located on top of the first head strap.

4. A bridle according to claim 3 wherein the first head strap and second head strap comprise broad straps.

5. A bridle according to claim 3 wherein the bridle is a snaffle bridle and wherein a snaffle bit is carried by said second head strap.

6. A bridle according to claim 3 wherein the bridle is a weymouth bridle and wherein a weymouth bit and a snaffle bit are carried by said second head strap.

7. A bridle according to claim 6 wherein said first head strap is padded.

8. A bridle according to claim 3 wherein the padded member provides an upwardly convex surface.

* * * * *